US009683330B2

(12) United States Patent
Inoue et al.

(10) Patent No.: US 9,683,330 B2
(45) Date of Patent: Jun. 20, 2017

(54) WET PAPER WEB TRANSFER BELT

(71) Applicant: Ichikawa Co., Ltd, Bunkyo-ku (JP)

(72) Inventors: Kenji Inoue, Bunkyo-ku (JP); Ryo Umehara, Bunkyo-ku (JP); Ai Tamura, Bunkyo-ku (JP); Yuta Sugawara, Bunkyo-ku (JP); Tomoyo Ogishima, Bunkyo-ku (JP)

(73) Assignee: Ichikawa Co., Ltd, Bunkyo-ku (JP)

( * ) Notice: Subject to any disclaimer, the term of this patent is extended or adjusted under 35 U.S.C. 154(b) by 0 days.

(21) Appl. No.: 15/158,150

(22) Filed: May 18, 2016

(65) Prior Publication Data

US 2016/0348311 A1 Dec. 1, 2016

(30) Foreign Application Priority Data

May 28, 2015 (JP) ..... 2015-119754

(51) Int. Cl.
*D21F 2/00* (2006.01)
*D21F 7/08* (2006.01)

(52) U.S. Cl.
CPC ..... *D21F 2/00* (2013.01); *D21F 7/086* (2013.01)

(58) Field of Classification Search
CPC ..... D21F 7/086; D21F 2/20
USPC ..... 162/306
See application file for complete search history.

(56) References Cited

U.S. PATENT DOCUMENTS 5,298,124 A 3/1994 Eklund et al.
6,962,885 B1 11/2005 Best
2010/0282426 A1 11/2010 Sawada et al.
2010/0319869 A1 12/2010 Inoue et al.
2014/0076510 A1* 3/2014 Inoue ..... D21F 7/086 162/202
2014/0076511 A1* 3/2014 Inoue ..... D21F 7/086 162/202

FOREIGN PATENT DOCUMENTS

| | | |
|---|---|---|
| EP | 2 206 828 A1 | 7/2010 |
| EP | 2 711 457 A1 | 3/2014 |
| EP | 2 711 458 A1 | 3/2014 |
| JP | 6-57678 | 3/1994 |
| JP | 1 069 235 A1 | 1/2001 |
| JP | 2009-127134 | 6/2009 |
| JP | 2014-62337 | 4/2014 |
| JP | 2014-62338 | 4/2014 |

OTHER PUBLICATIONS

Extended European Search Report issued Oct. 4, 2016 in Patent Application No. 16170218.8.

* cited by examiner

*Primary Examiner* — Mark Halpern
(74) *Attorney, Agent, or Firm* — Oblon, McClelland, Maier & Neustadt, L.L.P.

(57) ABSTRACT

There is provided a wet paper web transfer belt for transferring a wet paper web, comprising: a wet paper web carrying side resin layer having a wet paper web carrying surface for carrying the wet paper web; and a roll side resin layer having a roll contacting surface. A water swelling rate of a resin material constituting the wet paper web carrying side resin layer and a water swelling rate of a resin material constituting the roll side resin layer are different, and the water swelling rate of the resin material constituting the wet paper web carrying side resin layer is 2.0% or more and the water swelling rate of the resin material constituting the roll side resin layer is 10.0% or less.

6 Claims, 4 Drawing Sheets

WET PAPER WEB TRANSFER BELT

CROSS REFERENCE TO RELATED APPLICATION(S)

This application is based upon and claims benefit of priority from Japanese Patent Application No. 2015-119754, filed on May 28, 2015, the entire contents of which are incorporated herein by reference.

BACKGROUND

The present invention relates to a wet paper web transfer belt used in a papermaking machine.

Papermaking machines for removing moisture from the source material of paper are generally equipped with a wire part, a press part and a dryer part. These parts are arranged in the order of wire part, press part and dryer part in the wet paper web transfer direction.

Regarding passing of a wet paper web in the press part, there is currently known, as a papermaking machine, a closed-draw papermaking machine in which the wet paper web is passed in closed-draw. In the press part of the closed-draw papermaking machine, the wet paper web is transferred while being placed on a papermaking felt or a wet paper web transfer belt, and therefore there is no part in which the wet paper web travels on its own and occurrence of web breaks is prevented. Thus, the closed-draw papermaking machine has an excellent aptitude for high-speed operation and excellent operation stability.

One example of a press part of a typical closed-draw papermaking machine will be described by referring to FIG. 5. In FIG. 5, a wet paper web WW shown by a broken line is supported by a wire WF of a wire part, press felts PF1, PF2, and PF3 of a press part, a wet paper web transfer belt TB, and a dryer fabric DF of a dryer part and is transferred from left to right. As described above, there is no part in which the wet paper web is not supported in the closed-draw papermaking machine. As is well known, the wire WF, the press felts PF1, PF2, and PF3, the wet paper web transfer belt TB, and the dryer fabric DF are endless band-shaped bodies and are supported by guide rollers GR.

Note that, in FIG. 5, press rolls PR1, PR2, and PR3, a shoe PS, a shoe press belt SB, and a suction roll SR are all well-known structures. The press rolls PR1 and PR2 constitute a first press portion PP1, and the concave shoe PS corresponding to the press roll PR3 and the press roll PR3 constitute a second press portion PP2 via the shoe press belt SB.

Herein, a traveling state of the wet paper web WW in the closed-draw papermaking machine will be described. Note that, as a matter of course, the wet paper web WW has a continuous shape, and therefore the traveling state of a part of the wet paper web WW will be described.

First, the wet paper web WW passes through the wire WF of the wire part, the press felt 1 of the press part, and the first press portion PP1 in turn and is passed via the press felt PF2 to the press felt PF3. Then, the wet paper web WW is transferred by the press felt PF2 to the second press portion PP2. In the second press portion PP2, the wet paper web WW is pressed by the shoe PS via the shoe press belt SB and the press roll PR3 while being sandwiched between the press felt PF3 and the wet paper web transfer belt TB.

In this case, the press felt PF3 is configured to have high water permeability, and the wet paper web transfer belt TB is configured to have remarkably low water permeability.

Therefore, in the second press section PP2, moisture from the wet paper web WW moves to the press felt PF3.

Immediately after exiting from the second press section PP2, the press felt PF3, the wet paper web WW, and the wet paper web transfer belt TB are suddenly released from pressure and therefore swell in volume. Due to this swelling and a capillary action of pulp fibers constituting the wet paper web WW, a so-called "rewetting phenomenon" in which part of the moisture in the press felt PF3 moves to the wet paper web WW occurs.

As described above, however, the wet paper web transfer belt TB is configured to have remarkably low water permeability, and therefore no moisture is held on the inside thereof. Therefore, the rewetting phenomenon hardly occurs from the wet paper web transfer belt TB, and the wet paper web transfer belt TB contributes to improving water squeezing efficiency of the wet paper web. Note that the wet paper web WW that has exited from the second press portion PP2 is transferred by the wet paper web transfer belt TB. Then, the wet paper web WW is attached to the suction roll SR and is transferred by the dryer fabric DF to the dryer part.

Herein, the wet paper web transfer belt TB is demanded to have a function (wet paper web adhesive property) of transferring the wet paper web WW while causing the wet paper web WW to adhere to a wet paper web carrying surface (outer circumferential surface) of a wet paper web carrying side resin layer after the wet paper web transfer belt TB exits from the second press portion PP2 and a function (wet paper web release property) of smoothly releasing the wet paper web when the wet paper web WW is passed to the next part and is also demanded to have a function (antifouling property) of preventing contamination components (sizing agents, fillers, reactants thereof, and the like) contained in the wet paper web from adhering to or being accumulated on the wet paper web carrying surface.

Further, the wet paper web transfer belt TB is supported by a plurality of guide rollers GR and the press roll PR3 and therefore is particularly demanded to have wear resistance on a roll contacting surface (inner circumferential surface) of a roll side resin layer.

Some studies regarding the wet paper web transfer belt have been made for improving the wet paper web adhesive property and the wet paper web release property of the wet paper web carrying surface, i.e., wet paper web transfer properties thereof and improving the wear resistance of the roll side resin layer (for example, JP H6-57678A, JP 2014-62337A, JP 2014-62338A, EP patent application publication No. 1069235, specification, and JP 2009-127134A). JP H6-57678A, JP 2014-62337A, and JP 2014-62338A disclose a belt in which the wet paper web transfer properties are improved by setting surface roughness Ra or Rz of the belt within a predetermined range. EP patent application publication No. 1069235, specification discloses a belt in which the wet paper web transfer properties are improved by causing an outer layer of the belt to be porous.

JP 2009-127134A discloses a belt in which the wear resistance of a roll side layer is improved by providing the roll side layer made of batt fibers containing low melting point nylon and melting a roll contacting surface of the roll side layer to form a welded layer.

SUMMARY

However, improvement in the antifouling property of the wet paper web carrying surface and the wear resistance of the roll contacting surface is demanded while a circumstance of a raw material of paper is changing and operation conditions of a papermaking machine are becoming severe. Therefore, an object of the present invention is to provide a wet paper web transfer belt in which a wet paper web carrying surface has an excellent antifouling property and a roll contacting surface has excellent wear resistance.

The inventors of the present invention had diligently studied to achieve the above-mentioned object, and, as a result, found that water swelling rates of resin materials of resin layers constituting the wet paper web carrying surface and the roll contacting surface of the wet paper web transfer belt are strongly related to the antifouling property of the wet paper web carrying surface and the wear resistance of the roll contacting surface, and therefore the inventors focused on the water swelling rates.

The inventors of the present invention had studied for improving the antifouling property of the wet paper web carrying surface and the wear resistance of the roll contacting surface, and, as a result, found that, when the water swelling rates of the resin materials of a wet paper web carrying side resin layer having the wet paper web carrying surface and a roll side resin layer having the roll contacting surface are set within a predetermined range, an excellent antifouling property is exerted on the wet paper web carrying surface and excellent wear resistance is exerted on the roll contacting surface, thereby achieving the present invention.

That is, the present invention relates to the following.

(1) A wet paper web transfer belt for transferring a wet paper web, comprising:

a wet paper web carrying side resin layer having a wet paper web carrying surface for carrying the wet paper web; and a roll side resin layer having a roll contacting surface, wherein a water swelling rate of a resin material constituting the wet paper web carrying side resin layer and a water swelling rate of a resin material constituting the roll side resin layer are different, the water swelling rate of the resin material constituting the wet paper web carrying side resin layer is 2.0% or more, and the water swelling rate of the resin material constituting the roll side resin layer is 10.0% or less.

(2) The wet paper web transfer belt according to (1), wherein the water swelling rate of the resin material constituting the wet paper web carrying side resin layer is 3.7% or more.

(3) The wet paper web transfer belt according to (1), wherein the water swelling rate of the resin material constituting the roll side resin layer is 5.0% or less.

(4) The wet paper web transfer belt according to (1), wherein the water swelling rate of the resin material constituting the roll side resin layer is 3.6% or less.

(5) The wet paper web transfer belt according to (1), wherein the water swelling rate of the resin material constituting the roll side resin layer is 2.5% or less.

(6) The wet paper web transfer belt according to (1), wherein the water swelling rate of the resin material constituting the roll side resin layer is smaller than the water swelling rate of the resin material constituting the wet paper web carrying side resin layer.

By adopting the above-mentioned constitutions, it is possible to provide a wet paper web transfer belt in which adhesion and accumulation of contamination onto a wet paper web carrying surface of the wet paper web transfer belt are prevented and wear resistance of a roll contacting surface is improved.

DETAILED DESCRIPTION OF THE EMBODIMENT(S)

Figure 1:
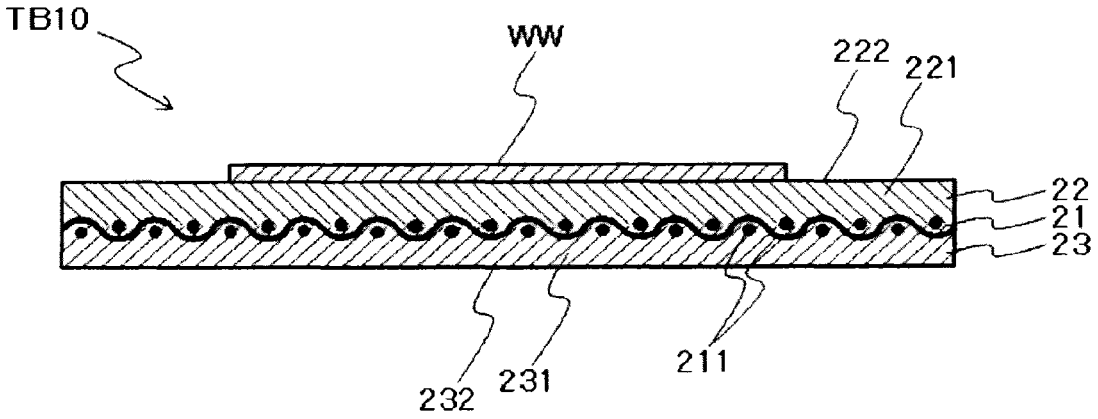
FIG. 1 is a cross-sectional view in a cross machine direction, showing one example of a wet paper web transfer belt according to a preferred embodiment of the present invention.

Hereinafter, referring to the appended drawings, preferred embodiments of the present invention will be described in detail. It should be noted that, in this specification and the appended drawings, structural elements that have substantially the same function and structure are denoted with the same reference numerals, and repeated explanation thereof is omitted.

FIG. 1 is a cross-sectional view in a cross machine direction, showing one example of a wet paper web transfer belt according to a preferred embodiment of the present invention. Note that, although a wet paper web WW to be transferred is shown in FIG. 1 to facilitate understanding, it is needless to say that the wet paper web WW is not the constitution of a wet paper web transfer belt TB10. Moreover, in FIG. 1, the size of each member is emphasized as appropriate to facilitate description, and FIG. 1 does not show the actual proportion or size of each member. Note that, in the following description, a machine direction will also be referred to as "MD" and a cross machine direction will also be referred to as "CMD".

The wet paper web transfer belt TB10 shown in FIG. 1 is used for the transfer and passing of the wet paper web WW in a press part of a papermaking machine. The wet paper web transfer belt TB10 forms an endless band-shaped body. In other words, the wet paper web transfer belt TB10 is an annular belt. Moreover, the circumferential direction of the wet paper web transfer belt TB10 is generally disposed along the machine direction (MD) of a papermaking machine.

The wet paper web transfer belt TB10 includes a reinforcing fibrous substrate layer 21, a wet paper web carrying side resin layer 22 provided on one principal surface on an outer surface side of the reinforcing fibrous substrate layer 21, and a roll side resin layer 23 provided on the other principal surface on an inner surface side of the reinforcing fibrous substrate layer 21 and is formed by laminating those layers. Moreover, the wet paper web carrying side resin layer 22 is a layer that forms an outer surface (outer circumferential surface) of an annular shape formed by the wet paper web transfer belt TB10, and the roll side resin layer 23 is a layer that forms an inner surface (inner circumferential surface) of the annular shape formed by the wet paper web transfer belt TB10.

The reinforcing fibrous substrate layer 21 comprises a reinforcing fibrous substrate 211, a resin material 221 of the wet paper web carrying side resin layer, and/or a resin material 231 of the roll side resin layer (In FIG. 1, the reinforcing fibrous substrate layer 21 comprises the reinforcing fibrous substrate 211, the resin material 221 of the wet paper web carrying side resin layer, and the resin material 231 of the roll side resin layer.). The resin material 221 of the wet paper web carrying side resin layer and/or the resin material 231 of the roll side resin layer are/is present in the reinforcing fibrous substrate layer 21 so as to fill gaps in fibers of the reinforcing fibrous substrate 211. In other words, the reinforcing fibrous substrate 211 is partially impregnated with the resin material 221 of the wet paper web carrying side resin layer and/or the resin material 231 of the roll side resin layer, i.e., the reinforcing fibrous substrate 211 is embedded in the resin material 221 of the wet paper web carrying side resin layer and/or the resin material 231 of the roll side resin layer. Note that, although description has been made assuming that an interface between the resin material 221 of the wet paper web carrying side resin layer and the resin material 231 of the roll side resin layer is positioned in the reinforcing fibrous substrate 211 in FIG. 1, this interface may be positioned above or below the reinforcing fibrous substrate layer 21. Moreover, it is also possible to arrange another third resin material between the resin material 221 of the wet paper web carrying side resin layer and the resin material 231 of the roll side resin layer and set the interface between the resin layers in an arbitrary position.

There are no particular limitations with regard to the reinforcing fibrous substrate 211, however, for example, fabrics woven by a weaving machine and the like from warp and weft yarns are commonly used. Moreover, it is also possible to use a grid-like web material of superimposed rows of warp and weft yarns without weaving.

The fineness of the fibers constituting the reinforcing fibrous substrate 211 is not particularly limited, for example, 300 to 10000 dtex, may be used.

Moreover, the fineness of the fibers constituting the reinforcing fibrous substrate 211 may be different depending on the part in which the fibers are used. For example, the fineness of the warp and weft yarns in the reinforcing fibrous substrate 211 may be different.

As the reinforcing fibrous substrate 211, it is possible to use one or a combination of two or more of polyesters (polyethylene terephthalate, polybutylene terephthalate, and the like), aliphatic polyamides (polyamide 6, polyamide 11, polyamide 12, polyamide 612, and the like), aromatic polyamides (aramid), polyvinylidene fluoride, polypropylene, polyether ether ketone, polytetrafluoroethylene, polyethylene, wool, cotton, metals, and the like.

As materials of the resin material 221 of the wet paper web carrying side resin layer and the resin material 231 of the roll side resin layer, it is possible to use one or a combination of two or more of thermosetting resins such as urethane, epoxy, acryl and the like, or thermoplastic resins such as polyamide, polyarylate, polyester, and the like. From the point of view of mechanical strength, wear resistance and flexibility, urethane resin can preferably be used.

The urethane resin used in the resin material 221 of the wet paper web carrying side resin layer and the resin material 231 of the roll side resin layer is, for example, urethane resin obtainable by curing a urethane prepolymer having a terminal isocyanate group, which is obtainable by reacting an aromatic or aliphatic polyisocyanate compound and polyol, with a curing agent having an active hydrogen group may be used. Moreover, it is possible to use an anionic, nonionic or cationic aqueous urethane resin of the forced emulsification type or selfemulsification type. In this case, for improving the water resistance, the aqueous urethane resin can be crosslinked by using a cross linking agent of melamine, epoxy, isocyanate, carbodiimide and the like together with the aqueous urethane resin.

Moreover, the resin material 221 of the wet paper web carrying side resin layer and the resin material 231 of the roll side resin layer may also comprise one type or a combination of two or more types of inorganic fillers such as titanium oxide, kaolin, clay, talc, diatomaceous earth, calcium carbonate, calcium silicate, magnesium silicate, silica, mica, and the like.

Note that, in this case, resin having a water swelling rate of 2.0% or more is selected as the resin material 221 of the wet paper web carrying side resin layer. When the resin material 221 of the wet paper web carrying side resin layer is selected as described above, it is possible to prevent contamination components (sizing agents, fillers, reactants thereof, and the like) contained in the wet paper web from adhering to or being accumulated on a wet paper web carrying surface 222.

As described above, the water swelling rate of the resin material 221 of the wet paper web carrying side resin layer only needs to be 2.0% or more but is more preferably 3.7% or more. With this, it is possible to more securely prevent contamination components (sizing agents, fillers, reactants thereof, and the like) contained in the wet paper web from adhering to or being accumulated on the wet paper web carrying surface 222.

Further, resin whose water swelling rate is preferably 10.0% or less is selected as the resin material 231 of the roll side resin layer. When the resin material 231 of the roll side resin layer is selected as described above, a roll contacting surface 232 of the roll side resin layer can have excellent wear resistance.

As described above, the water swelling rate of the resin material 231 of the roll side resin layer only needs to be 10.0% or less but is preferably 5.0% or less, more preferably 3.6% or less, and still more preferably 2.5% or less. With this, the roll contacting surface 232 of the roll side resin layer can have excellent wear resistance more securely.

Also, the water swelling rate of a resin material 221 constituting the wet paper web carrying side resin layer 22 and the water swelling rate of a resin material 231 constituting the roll side resin layer 23 are different.

In the present specification, the swelling rate (water swelling rate, %) of the resin material with water represents the weight change rate of the resin weight before the resin material is immersed in warm water of 40° C. for 30 hours and after the resin material is immersed in warm water of 40° C. for 30 hours and can be defined by the equation hereinafter.

Water swelling rate (%)=(resin weight after swelling with water−resin weight before swelling with water)/(resin weight before swelling with water)×100(%).

Further, the swelling rate of the resin material is measured after moisture control by exposing the resin prior to immersion to an environment of a temperature of 20° C. and a relative humidity of 60% (exposing the resin until a change in weight thereof is stopped).

The wet paper web carrying side resin layer 22 is a layer that is provided on the one principal surface of the reinforcing fibrous substrate layer 21 and is mainly made of a resin material. The wet paper web carrying side resin layer 22 can be in contact with the wet paper web WW on a principal surface opposite to the principal surface joined to the reinforcing fibrous substrate layer 21 and has the wet paper web carrying surface 222 for carrying the wet paper web WW. In other words, the wet paper web transfer belt TB10 can transfer the wet paper web WW while carrying the wet paper web WW on the wet paper web carrying surface 222 of the wet paper web carrying side resin layer 22.

Although arithmetic average roughness Ra of the wet paper web carrying surface 222 is not particularly limited, the arithmetic average roughness Ra is preferably 1.5 to 20 μm, more preferably 2.0 to 12.0 μm, and still more preferably 2.5 to 9.0 μm. With this, the above-mentioned adhesive property and release property of the wet paper web WW with the wet paper web transfer belt TB10 are improved.

Note that, in this specification, the arithmetic average roughness Ra means arithmetic average roughness defined in JIS B0601.

Note that it is possible to measure the above-mentioned Ra of an arbitrary curved surface and curved line on the wet paper web carrying surface 222, and, in the case where polishing marks are formed on the wet paper web carrying surface 222, it is also possible to perform measurement so as to cross a polishing mark direction and preferably in a direction vertical to the polishing mark direction.

The dimensions of the wet paper web transfer belt TB10 described above are not particularly limited, as the dimensions may be suitably set according to the use of the wet paper web transfer belt.

The width of the wet paper web transfer belt TB10 is not particularly limited, however, the width may, for example, be 700 to 13,500 mm, or preferably 2,500 to 12,500 mm.

The length (circumferential length) of the wet paper web transfer belt TB10 is not particularly limited, however, the length may, for example, be 4 to 35 m, or preferably 10 to 30 m.

Moreover, the thickness of the wet paper web transfer belt TB10 is not particularly limited, however, the thickness may, for example, be 1.5 to 7.0 mm, or preferably 2.0 to 6.0 mm. Each part of the wet paper web transfer belt TB10 may have a different thickness or may all have the same thickness.

The wet paper web transfer belt TB10 described above can be produced by a production method of a wet paper web transfer belt according to an embodiment of the present invention described below.

From the above, in the wet paper web transfer belt TB10 according to the present embodiment, the water swelling rate of the resin material 221 of the wet paper web carrying side resin layer has a predetermined value to thereby prevent adhesion and accumulation of contamination onto the wet paper web carrying surface 222, and the water swelling rate of the resin material 231 of the roll side resin layer has a predetermined value to thereby improve the wear resistance of the roll contacting surface 232.

As a modification example of the wet paper web transfer belt TB10 described above, there is an embodiment in which a wet paper web transfer belt comprises a layer(s) obtainable by needling batt fibers on a wet paper web carrying side and/or roll side of the reinforcing fibrous substrate 211 and impregnating the batt fibers with the resin material(s) described above. Note that, as a material of the batt fibers, it is possible to use one type or a combination of two or more types of materials that can be used in the reinforcing fibrous substrate 211.

Figure 2A:
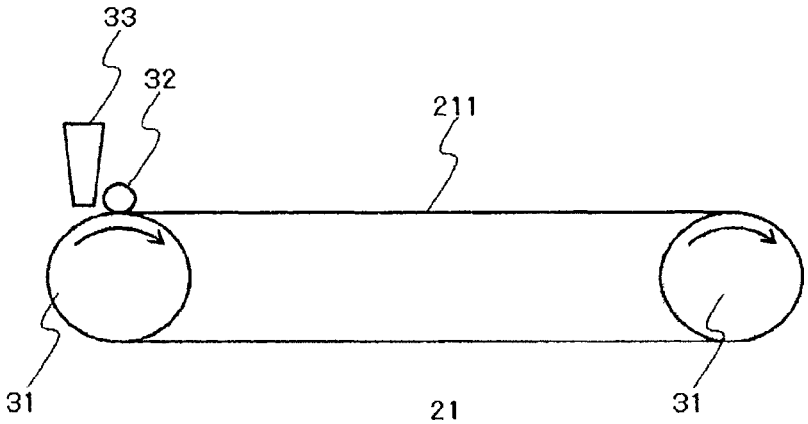
FIGS. 2A to 2C are schematic diagrams showing a preferred embodiment of a production method (laminating step) of a wet paper web transfer belt according to the present invention.
Figure 2B:
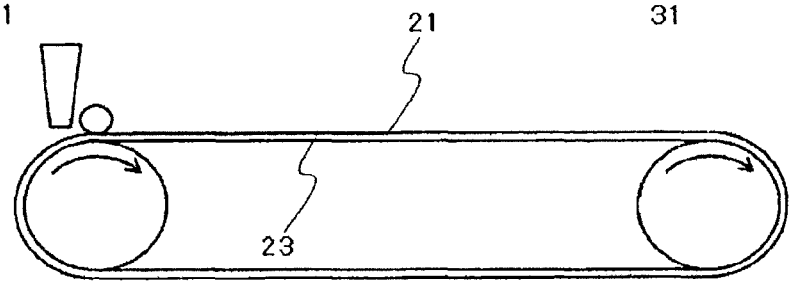
Figure 2C:
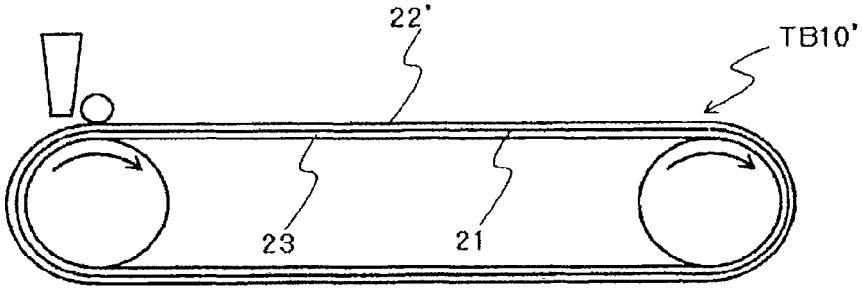
Figure 3:
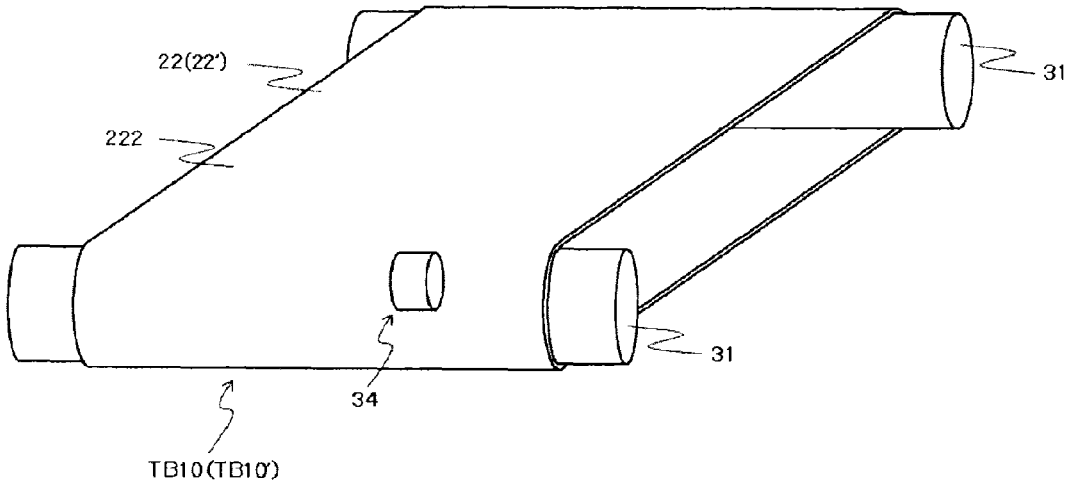
FIG. 3 is a schematic diagram showing a preferred embodiment of the production method (polishing step) of the wet paper web transfer belt according to the present invention.

One example of a preferred embodiment of a production method of the above-mentioned wet paper web transfer belt according to the present invention will be described. FIGS. 2A to 2C are schematic diagrams showing one example of a laminating step in a preferred embodiment of the production method of the wet paper web transfer belt according to the present invention, and FIG. 3 is a schematic diagram showing one example of a wet paper web carrying side resin layer forming step in the preferred embodiment of the production method of the wet paper web transfer belt according to the present invention.

The production method of the wet paper web transfer belt TB10 according to the present embodiment includes a step (laminating step) of forming an annular laminated body TB10' comprising the roll side resin layer 23 as the innermost layer and the wet paper web carrying side resin layer 22 as the outermost layer.

In the laminating step, the annular and band-shaped laminated body TB10' comprising the roll side resin layer 23 as the innermost layer and a precursor 22' of the wet paper web carrying side resin layer as the outermost layer is formed. Although the laminated body TB10' may be formed by any method, in the present embodiment, first, the reinforcing fibrous substrate layer 21 is formed by coating the resin material of the roll side resin layer 23 onto the reinforcing fibrous substrate 211 so that the resin material penetrates the reinforcing fibrous substrate 211, and, at the same time, the roll side resin layer 23 is formed on the inside of the reinforcing fibrous substrate layer 21. Then, the precursor 22' of the wet paper web carrying side resin layer is formed by coating the resin material of the wet paper web carrying side resin layer 22 onto an outer surface of the formed reinforcing fibrous substrate layer 21.

Specifically, as shown in FIG. 2A, the annular and band-shaped reinforcing fibrous substrate 211 is installed to be in contact with two rolls 31 arranged in parallel.

Then, as shown in FIG. 2B, the resin material of the roll side resin layer 23 is applied to an outer surface of the reinforcing fibrous substrate 211. Although the resin material may be applied by any method, in the present embodiment, the resin material is applied to the reinforcing fibrous substrate 211 by discharging the resin material through a resin discharge opening 33 while rotating the reinforcing fibrous substrate 211 around the rolls 31. Moreover, at the same time, the applied resin material is uniformly coated onto the reinforcing fibrous substrate 211 by using a coating bar 32. The resin material coated at this time can penetrate the reinforcing fibrous substrate 211. Therefore, in the present embodiment, it is possible to apply the resin contained in the reinforcing fibrous substrate 211 and the resin material constituting the roll side resin layer 23 at the same time, and thus it is possible to form the reinforcing fibrous substrate layer 21 and the roll side resin layer 23 at the same time.

Then, as shown in FIG. 2C, the resin material of the wet paper web carrying side resin layer 22 is applied to the outer surface of the formed reinforcing fibrous substrate layer 21. Although the resin material may be applied by any method, in the present embodiment, the resin material is applied to the outer surface of the reinforcing fibrous substrate layer 21 by discharging the resin material through the resin discharge opening 33 while rotating the formed reinforcing fibrous substrate layer 21 and roll side resin layer 23 around the rolls 31. Moreover, at the same time, the applied resin material is uniformly coated by using the coating bar 32. Note that the resin material constituting each layer may also be applied as a mixture with the above-mentioned inorganic filler.

In this case, the water swelling rate of the resin material forming the wet paper web carrying side resin layer 22 is set to 2.0% or more and more preferably 3.7% or more. Moreover, the water swelling rate of the resin material forming the roll side resin layer 23 is set to 10.0% or less, preferably 5.0% or less, more preferably 3.6% or less, and still more preferably 2.5% or less.

Thereafter, the coated resin materials are cured. In this way, the laminated body TB10', in which the precursor 22' of the wet paper web carrying side resin layer, the reinforcing fibrous substrate layer 21, and the roll side resin layer 23 are laminated in this order from the outer surface, is obtained. A method of curing the resin materials is not particularly limited, but the curing may be performed by, for example, heating and/or UV irradiation.

Moreover, in the case where the resin materials are cured by heating, for example, a far infrared heater or other method may be used. Further, in the case where the resin materials are cured by heating, the heating temperature of the resin materials is preferably 60 to 150° C., and still more preferably 90 to 140° C. Furthermore, the heating time can, for example, be 2 to 24 hours, and preferably 3 to 20 hours.

Then, surface roughness of an outer surface of the precursor 22' of the wet paper web carrying side resin layer is adjusted to form the wet paper web carrying side resin layer 22 having the wet paper web carrying surface 222. In this way, the wet paper web transfer belt TB10, in which the wet paper web carrying surface 222 is formed, is obtained.

The surface roughness of the outer surface can be adjusted by, for example, polishing and/or buffing. Specifically, as shown in FIG. 3, this adjustment is performed by bringing a polishing device 34 or a buffing device (not shown) into contact with the laminated body TB10' that is installed on the two rolls 31. In this way, the wet paper web carrying surface 222 can have a desired arithmetic average roughness.

Note that, in the case where the wet paper web carrying surface 222 of the wet paper web transfer belt TB10 has a desired state before polishing or buffing, polishing and/or buffing may be omitted.

Note that, in the above-mentioned production method of the wet paper web transfer belt TB10, a roll side resin material is caused to penetrate the reinforcing fibrous substrate 211 from the outer surface thereof, thereby forming the roll side resin layer 23 on the inner surface (penetration manufacturing method). It is also possible to employ the following method (reverse manufacturing method): the roll side resin material is applied to the outer surface of the reinforcing fibrous substrate 211, thereby forming the reinforcing fibrous substrate layer 21 and the roll side resin layer 23 laminated on the outer surface, and then the reinforcing fibrous substrate 211 is reversed and the resin material of the wet paper web carrying side resin layer 22 is coated onto the outer surface (inner surface before the reinforcing fibrous substrate 211 is reversed) of the reinforcing fibrous substrate layer 21, thereby forming the precursor 22' of the wet paper web carrying side resin layer.

Further, as a modified embodiment of the above-mentioned production method of the wet paper web transfer belt TB10, there is an embodiment in which, instead of the reinforcing fibrous substrate 211, a reinforcing fibrous substrate in which batt fibers are needled on a wet paper web carrying side and/or roll side of the reinforcing fibrous substrate is used. With this, it is possible to obtain a wet paper web transfer belt comprising a wet paper web carrying side resin layer and/or roll side resin layer in which the above-mentioned batt fiber layer is impregnated with a resin material.

Examples

Hereinafter, the present invention will be described more specifically by means of Examples, but the present invention is not limited to those Examples.

1. Production of Wet Paper Web Transfer Belt

First, wet paper web transfer belts having the following constitution in Examples 1 to 10 and Comparative Examples 1 to 4 were produced.

<Reinforcing Fibrous Substrate>

The following constitution was used for reinforcing fibrous substrates of the wet paper web transfer belts in Examples 1 to 4, 6 to 8, and Comparative Examples 1, 2, and 4.

Upper warp yarn: twisted monofilament of 2000 dtex made from polyamide 6

Lower warp yarn: twisted monofilament of 2000 dtex made from polyamide 6

Weft yarn: twisted monofilament of 1400 dtex made from polyamide 6

Weave: double warp weave of 40 upper/lower warp yarns/5 cm and 40 weft yarns/5 cm Reinforcing fibrous substrates of wet paper web transfer belts in Examples 5 and 10 were obtained by entangling and integrating 100 g/m$^2$ of batt fibers made of rayon and having the fineness of 3.3 dtex with a back surface (roll side surface) of the reinforcing fibrous substrate in Example 1 by needle punching. Note that the entire density of the reinforcing fibrous substrate at this time was 0.35 g/cm$^3$.

A reinforcing fibrous substrate of a wet paper web transfer belt in Example 9 was obtained by entangling and integrating 100 g/m$^2$ of batt fibers made of polyamide 66 and having the fineness of 22 dtex with the back surface (roll side surface) of the reinforcing fibrous substrate in Example 1 by needle punching.

A reinforcing fibrous substrate of a wet paper web transfer belt in Comparative Example 3 was obtained by entangling and integrating 300 g/m$^2$ of batt fibers made of rayon and having the fineness of 3.3 dtex with the back surface (roll side surface) of the reinforcing fibrous substrate in Example 1 by needle punching. Note that the entire density of the reinforcing fibrous substrate at this time was 0.50 g/cm$^3$.

<Resin Material>

A wet paper web carrying side resin material in Example 1 was obtained by reacting a mixture of diphenylmethane diisocyanate (MIDI) and polytetramethylene glycol (PTMG) with dimethylthiotoluenediamine (DMTDA; hereinafter, referred to as "E3"). A roll side resin material in Example 1 was obtained by reacting a mixture of tolylenediisocyanate (TDI) and polytetramethylene glycol (PTMG) with E3.

A wet paper web carrying side resin material in Example 2 was obtained by reacting the mixture of TDI and PTMG with a mixture (molar ratio, E3:PEG=8:2) of E3 and polyethylene glycol (PEG300) having an average molecular weight of 300. A roll side resin material in Example 2 was the same as the roll side resin material in Example 1.

A wet paper web carrying side resin material in Example 3 was the same as the wet paper web carrying side resin material in Example 2. A roll side resin material in Example 3 was obtained by reacting the mixture of MDI and PTMG with 1,4-butanediol (BD).

A wet paper web carrying side resin material in Example 4 was the same as the wet paper web carrying side resin material in Example 2. A roll side resin material in Example 4 was obtained by adding kaolin (corresponding to 35 wt % of a roll side resin layer) to aqueous urethane (obtained by reacting an anionic urethane dispersion with a melamine/formaldehyde cross-linking agent).

A wet paper web carrying side resin material in Example 5 was the same as the wet paper web carrying side resin material in Example 2. A roll side resin material in Example 5 was the same as the roll side resin material in Example 1. Note that batt fibers made of rayon and needle-punched on the reinforcing fibrous substrate were embedded in a roll side resin layer.

A wet paper web carrying side resin material in Example 6 was obtained by reacting the mixture of TDI and PTMG with polyethylene glycol (PEG400) having an average molecular weight of 400. A roll side resin material in Example 6 was the same as the roll side resin material in Example 1.

A wet paper web carrying side resin material in Example 7 was obtained by adding kaolin (corresponding to 35 wt % of a wet paper web carrying side resin layer) to aqueous urethane (obtained by reacting an anionic urethane dispersion with a melamine/formaldehyde cross-linking agent). A roll side resin material in Example 7 was the same as the roll side resin material in Example 1.

A wet paper web carrying side resin material in Example 8 was the same as the wet paper web carrying side resin material in Example 7. A roll side resin material in Example 8 was the same as the roll side resin material in Example 3.

A wet paper web carrying side resin material in Example 9 was the same as the wet paper web carrying side resin material in Example 7. A roll side resin material in Example 9 was the same as the roll side resin material in Example 1. Note that batt fibers made of polyamide 66 and needle-punched on the reinforcing fibrous substrate were embedded in a roll side resin layer.

A wet paper web carrying side resin material in Example 10 was the same as the wet paper web carrying side resin material in Example 7. A roll side resin material in Example 10 was the same as the roll side resin material in Example 1. Note that batt fibers made of rayon and needle-punched on the reinforcing fibrous substrate were embedded in a roll side resin layer.

A wet paper web carrying side resin material and a roll side resin material in Comparative Example 1 were obtained by reacting the mixture of TDI and PTMG with E3.

A wet paper web carrying side resin material in Comparative Example 2 was obtained by reacting the mixture of TDI and PTMG with BD. A roll side resin material in Comparative Example 2 was obtained by reacting the mixture of TDI and PTMG with E3.

A wet paper web carrying side resin material in Comparative Example 3 was the same as the wet paper web carrying side resin material in Example 7. A roll side resin material in Comparative Example 3 was obtained by reacting the mixture of TDI and PTMG with E3. Note that batt fibers made of rayon and needle-punched on the reinforcing fibrous substrate were embedded in a roll side resin layer.

A wet paper web carrying side resin material in Comparative Example 4 was the same as the wet paper web carrying side resin material in Example 7. A roll side resin material in Comparative Example 4 was aqueous urethane (anionic urethane dispersion).

<Formation of Laminated Body>

A reinforcing fibrous substrate layer and a roll side resin layer were formed by applying the resin material constituting each roll side resin layer in Examples 1 to 10 and Comparative Examples 1 to 4 to an outer surface of each reinforcing fibrous substrate, causing the reinforcing fibrous substrate to be impregnated with the resin material, and laminating the resin material thereon. Then, the resin material of each wet paper web carrying side resin layer was applied to an outer surface of each formed reinforcing fibrous substrate layer to laminate the wet paper web carrying side resin layer. A laminated body obtained by laminating the wet paper web carrying side resin layer, the reinforcing fibrous substrate layer, and the roll side resin layer in this order from the outermost layer was cured, and thus a semi-finished product of the wet paper web transfer belt was obtained.

Note that laminated bodies in Examples 1 to 4, 6 to 8 and Comparative Examples 1, 2, and 4 were formed by the reverse manufacturing method, and laminated bodies in Examples 5, 9, and 10 and Comparative Example 3 were formed by the penetration manufacturing method.

<Polishing, Buffing>

Wet paper web carrying surfaces of the wet paper web transfer belts (semi-finished products) in Examples 1 to 10 and Comparative Examples 1 to 4 were polished by suitably installing grit 80 to 600 polishing paper or cloth in a polishing device. Moreover, buffing was suitably performed for adjusting surface roughness of a wet paper web carrying surface, and arithmetic average roughness of the wet paper web carrying surface of the wet paper web transfer belt in each example was set to be 3.0 μm. In this way, the wet paper web transfer belts were formed.

Note that work dimension thereof was the length of 20.5 m and the width of 900 mm.

<Water Swelling Rate of Resin Material>

The water swelling rates of the resin materials used in the examples with water are shown in Table 1 below.

2. Evaluation of Wet Paper Web Transfer Belt

The wet paper web transfer belt was installed on a device for evaluating a wet paper web transfer belt shown in FIG. 4, and the wet paper web transfer belt was traveled in the following test conditions, and thereafter a state of adhesion and accumulation of contamination onto the wet paper web carrying surface and a state of wear of the roll side resin layer were evaluated.

<Test Conditions>

Test speed: 1000 m/min

Test time: 24 Hr

Pressure: 70 kN/m

Dimension: Length 20.5 m×width 700 mm (A width of 200 mm of the manufactured wet paper web transfer belt was cut, sample pieces (100 mm×100 mm, N=5) were collected from this cutting margin, the average weight of the sample pieces was calculated, and the average weight was set to be the weight of the wet paper web transfer belt before the test.)

Shower amount: 20 L/min/$m^2$ (wet paper web carrying surface and roll contacting surface)

Figure 4:
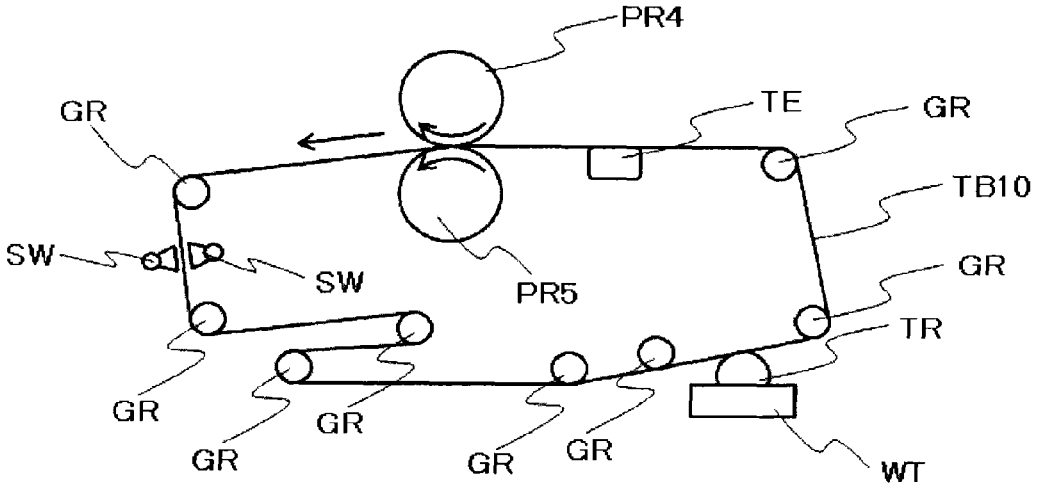
FIG. 4 is a schematic diagram showing a device for evaluating a wet paper web transfer belt.
Figure 5:
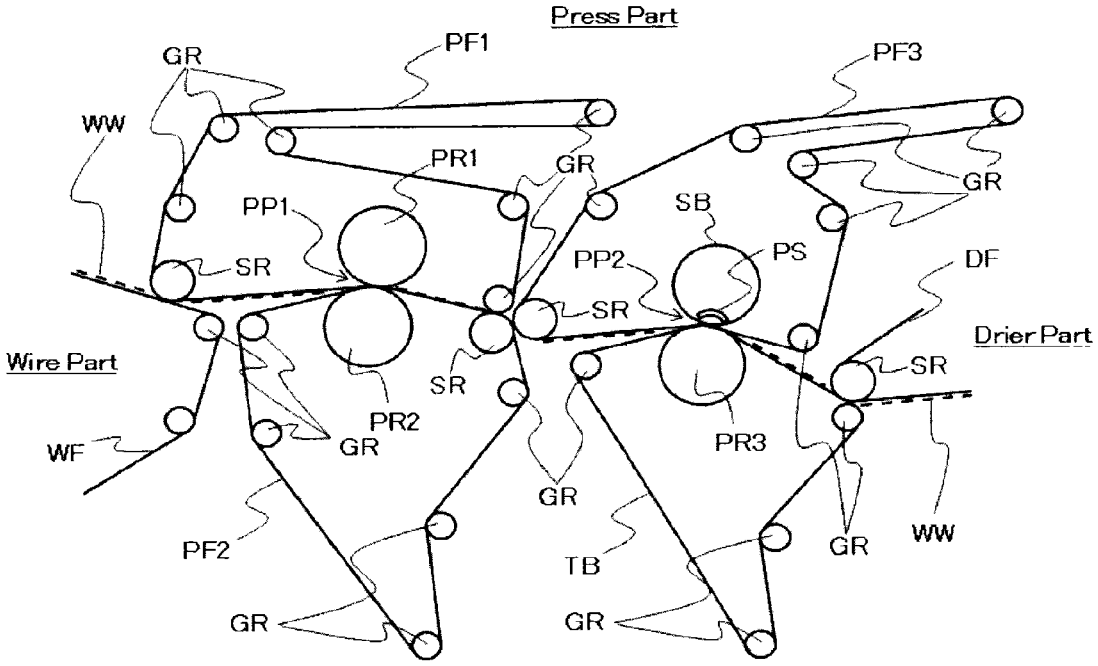
FIG. 5 is a schematic diagram mainly showing one example of a press part of a papermaking machine.

(1) Evaluation of State of Adhesion and Accumulation of Contamination onto Wet Paper Web Carrying Surface A water tank WT of the device for evaluating a wet paper web transfer belt shown in FIG. 4 was filled with a contamination liquid, and the contamination liquid was transferred to the wet paper web carrying surface by a transfer roll TR during travelling of the wet paper web transfer belt. As the contamination liquid, an ASA+$CaCO_3$ dispersion liquid (a cationic starch aqueous solution having a cationic starch concentration of 3.6% was mixed with ASA having 16C alkenyl group so that a ASA component was 2.0%, and heavy calcium carbonate was added to this mixed liquid so that heavy calcium carbonate was 15% of the whole liquid) was used.

After the test was completed, the state of adhesion and accumulation of contamination onto the wet paper web carrying surface of the wet paper web transfer belt was visually evaluated. Note that the state of adhesion and accumulation of contamination was evaluated as follows.

"Excellent": No contamination is adhered or accumulated.

"Good": Contamination is slightly adhered or accumulated but is not problematic in operation.

"Poor": Contamination is obviously adhered or accumulated and is problematic in operation.

Evaluation results of the state of adhesion and accumulation of contamination onto the wet paper web carrying surfaces in Examples 1 to 10 and Comparative Example 1 to 4 after the test are shown in Table 2.

(2) Evaluation of Wear Amount of Roll Side Resin Layer

A worn cloth (non-woven fabric made of nylon) was attached to a wear terminal TE of the device for evaluating a wet paper web transfer belt shown in FIG. 4, and the worn cloth was in contact with the roll side surface of the wet paper web transfer belt during travelling of the wet paper web transfer belt.

After the test was completed, sample pieces (100 mm×100 mm, N=5) were collected from the wet paper web transfer belt, and the wet paper web carrying surfaces and the roll contacting surfaces were washed, and then an average weight thereof was calculated. The average weight was set to be the weight of the wet paper web transfer belt after the test. Herein, the wear amount was defined by the following equation and was evaluated.

$$\text{Wear amount (mg/cm}^2\text{)}=\{\text{weight before test (mg)}-\text{weight after test (mg)}\}/100\ \text{cm}^2$$

Evaluation results of the wear amounts in Examples 1 to 10 and Comparative Examples 1 to 4 after the test are shown in Table 2.

TABLE 2

| | Evaluation of state of adhesion/accumulation of contamination (visual observation) | Wear amount (mg/cm$^2$) |
|---|---|---|
| Example 1 | Good | 0.5 |
| Example 2 | Excellent | 0.5 |
| Example 3 | Excellent | 0.5 |
| Example 4 | Excellent | 0.7 |
| Example 5 | Excellent | 1.0 |
| Example 6 | Excellent | 0.5 |
| Example 7 | Excellent | 0.5 |
| Example 8 | Excellent | 0.5 |
| Example 9 | Excellent | 0.6 |
| Example 10 | Excellent | 1.0 |
| Comparative Example 1 | Poor | 0.5 |
| Comparative Example 2 | Poor | 0.5 |
| Comparative Example 3 | Excellent | 1.5 |
| Comparative Example 4 | Excellent | 2.2 |

As shown in Table 1, the wet paper web transfer belts in Examples 1 to 10 have no problem in terms of adhesion and accumulation of contamination onto the wet paper web carrying surface and have excellent wear resistance of the roll side resin layer. In particular, adhesion and accumulation of contamination onto the wet paper web carrying surface was remarkably prevented when the water swelling rate of the resin material of the wet paper web carrying side layer was 3.7% or more, and the wear resistance of the roll side resin layer was remarkable when the water swelling rate of the resin material of the roll side layer was 3.6% or less.

Heretofore, preferred embodiments of the present invention have been described in detail with reference to the appended drawings, but the present invention is not limited thereto. It should be understood by those skilled in the art

TABLE 1

| | Wet paper web carrying side layer resin material | | Roll side layer resin material | |
|---|---|---|---|---|
| | Water swelling rate % | Components | Water swelling rate % | Components |
| Example 1 | 2.1 | MDI/PTMG/E3 | 1.5 | TDI/PTMG/E3 |
| Example 2 | 3.7 | TDI/PTMG/(E3:PEG300 = 8:2) | 1.5 | TDI/PTMG/E3 |
| Example 3 | 3.7 | TDI/PTMG/(E3:PEG300 = 8:2) | 2.5 | MDI/PTMG/BD |
| Example 4 | 3.7 | TDI/PTMG/(E3:PEG300 = 8:2) | 5.0 | Aqueous urethane (melamine cross linking) + kaolin 35% |
| Example 5 | 3.7 | TDI/PTMG/(E3:PEG300 = 8:2) | 10.0 | TDI/PTMG/E3 + rayon batt (ρ0.35) |
| Example 6 | 5.0 | TDI/PTMG/PEG400 | 1.5 | TDI/PTMG/E3 |
| Example 7 | 5.0 | Aqueous urethane (melamine cross linking) + kaolin 35% | 1.5 | TDI/PTMG/E3 |
| Example 8 | 5.0 | Aqueous urethane (melamine cross linking) + kaolin 35% | 2.5 | MDI/PTMG/BD |
| Example 9 | 5.0 | Aqueous urethane (melamine cross linking) + kaolin 35% | 3.6 | TDI/PTMG/E3 + PA66 batt |
| Example 10 | 5.0 | Aqueous urethane (melamine cross linking) + kaolin 35% | 10.0 | TDI/PTMG/E3 + rayon batt (ρ0.35) |
| Comparative Example 1 | 1.5 | TDI/PTMG/E3 | 1.5 | TDI/PTMG/E3 |
| Comparative Example 2 | 1.9 | TDI/PTMG/BD | 1.5 | TDI/PTMG/E3 |
| Comparative Example 3 | 5.0 | Aqueous urethane (melamine cross linking) + kaolin 35% | 12.0 | TDI/PTMG/E3 + rayon batt (ρ0.50) |
| Comparative Example 4 | 5.0 | Aqueous urethane (melamine cross linking) + kaolin 35% | 15.0 | Aqueous urethane (no cross linking agent) |

that various changes and alterations may be made without departing from the spirit and scope of the appended claims.

What is claimed is:

1. A wet paper web transfer belt for transferring a wet paper web, comprising:

a wet paper web carrying side resin layer having a wet paper web carrying surface for carrying the wet paper web; and a roll side resin layer having a roll contacting surface, wherein a water swelling rate of a resin material constituting the wet paper web carrying side resin layer and a water swelling rate of a resin material constituting the roll side resin layer are different, the water swelling rate of the resin material constituting the wet paper web carrying side resin layer is 2.0% or more, and the water swelling rate of the resin material constituting the roll side resin layer is 10.0% or less.

2. The wet paper web transfer belt according to claim 1, wherein the water swelling rate of the resin material constituting the wet paper web carrying side resin layer is 3.7% or more.

3. The wet paper web transfer belt according to claim 1, wherein the water swelling rate of the resin material constituting the roll side resin layer is 5.0% or less.

4. The wet paper web transfer belt according to claim 1, wherein the water swelling rate of the resin material constituting the roll side resin layer is 3.6% or less.

5. The wet paper web transfer belt according to claim 1, wherein the water swelling rate of the resin material constituting the roll side resin layer is 2.5% or less.

6. The wet paper web transfer belt according to claim 1, wherein the water swelling rate of the resin material constituting the roll side resin layer is smaller than the water swelling rate of the resin material constituting the wet paper web carrying side resin layer.

* * * * *